US008308396B2

(12) United States Patent
Shook

(10) Patent No.: US 8,308,396 B2
(45) Date of Patent: Nov. 13, 2012

(54) FLOOD VENT

(76) Inventor: Ted Shook, Galveston, TX (US)

( * ) Notice: Subject to any disclaimer, the term of this patent is extended or adjusted under 35 U.S.C. 154(b) by 147 days.

(21) Appl. No.: 12/657,535

(22) Filed: Jan. 22, 2010

(65) Prior Publication Data

US 2011/0182669 A1 Jul. 28, 2011

(51) Int. Cl.
*E02B 7/40* (2006.01)

(52) U.S. Cl. ..... 405/100; 405/94; 52/169.5

(58) Field of Classification Search ..... 405/80, 405/87, 88, 89, 90, 91, 92, 94, 95, 99, 100; 52/169.5
See application file for complete search history.

(56) References Cited

U.S. PATENT DOCUMENTS

| | | | | |
|---|---|---|---|---|
| 2,105,735 | A | 10/1936 | Hodge | |
| 2,774,116 | A | 8/1954 | Wolverton | |
| 3,918,187 | A * | 11/1975 | Vogele | 405/94 |
| 4,754,696 | A | 7/1988 | Sarazen et al. | |
| 5,293,920 | A | 3/1994 | Vagedes | |
| 5,487,701 | A | 1/1996 | Schedegger et al. | |
| 5,809,731 | A * | 9/1998 | Reiss | 52/169.5 |
| 5,944,445 | A | 8/1999 | Montgomery | |
| 6,287,050 | B1 | 9/2001 | Montgomery et al. | |
| 6,485,231 | B2 | 11/2002 | Montgomery et al. | |
| 6,692,187 | B2 | 2/2004 | Sprengle et al. | |
| 7,270,498 | B1 | 9/2007 | Albanese et al. | |
| 7,484,286 | B2 * | 2/2009 | Fowler | 29/401.1 |
| 7,600,944 | B1 * | 10/2009 | Keating | 405/96 |
| 7,926,539 | B1 * | 4/2011 | Hurst et al. | 405/92 |
| 2006/0289127 | A1 * | 12/2006 | Fowler | 160/180 |
| 2008/0236062 | A1 * | 10/2008 | Bergaglio | 52/169.5 |
| 2009/0208289 | A1 * | 8/2009 | Flury | 405/94 |

* cited by examiner

*Primary Examiner* — Frederick L Lagman
(74) *Attorney, Agent, or Firm* — Royston Rayzor Vickery & Williams L.L.P.; William P. Glenn, Jr.

(57) ABSTRACT

A flood vent is provided that allows the unimpeded flow of floodwater in a shuttered duct formed in a housing installed in a structure such as a building. A lower region of the duct is angled down between two and eight degrees from a horizontal plane to form a sill that sheds water to an exterior of the structure, and an upper region of the duct is pivotally fixed to a shutter positioned within the duct. The shutter is capable of swinging between a closed position and an open position in response to the presence of floodwater within at least a portion of the duct. Movement of the shutter to, from or through a closed position is hampered by a releasable coupling of the shutter to the sill by a fin.

2 Claims, 7 Drawing Sheets

FLOOD VENT

BACKGROUND OF THE INVENTION

1. Field of the Invention

This invention relates to structure venting, in particular, to a flood vent that opens to permit the flow of water in or out of a structure, such a house or garage, when the water level rises thereby avoiding an excessive pressure differential to develop between the interior and exterior of the structure as well as damage or failure of the structure.

2. Description of the Related Art

To eliminate or at least reduce damage due to flooding, several building code entities as well as the federal government have developed rules and regulations requiring structures with enclosed spaces located below defined flood plain levels to include automatic equalization of interior and exterior hydrostatic pressure caused by floodwaters. The rules and regulations require structures to be designed and built to allow floodwaters to move in and out of a structure freely. The Federal Emergency Management Agency (FEMA) requires compliance with FEMA Technical Bulletin 1-93. Other governmental agencies required compliance with the International Building Code and/or ASME 24-05 and 24-98.

A number of devices have been developed to reduce or eliminate the pressure differential that may develop between the interior and exterior of a structure. In 1935, Hodge developed and was issued in 1938, U.S. Pat. No. 2,105,735 for a device that would relieve pressure that may develop within a closed chamber. The device focused upon the release of gas pressure from within the structure but provided for no means to reduce the pressure differential that could develop when the internal pressure of the closed chamber was less than the surrounding pressure. In 1954, Wolverton filed an application for a double acting relief valve and was issued a U.S. Pat. No. 2,774,116 in 1956. Wolverton's double acting relief valve addressed the shortfall for Hodge's device by double hinging a plate mounted in a structure's door that would activate to equalize the pressure differential, if any, between a storm door and main door. The Wolverton device did not address the issues associated with pressure differentials created by floodwaters, nor did the Wolverton device address ventilation.

In 1993, Wagedes filed an application for an improved louvered basement vent and was issued U.S. Pat. No. 5,293,920 in 1994. Wagedes' improved louvered basement vent included a frame and a screened opening. The louvers could be held open by engaging louver detents against frame tabs. The louvers open automatically to relieve excessive pressure in the structure and would remain open if the louvers engaged the frame tabs. While the Wagedes improved louvered basement vent was screened—where the prior discussed patents were not, it was limited to addressing only one type of pressure differentials—namely over pressurization of the structure. Furthermore, the Wagedes improved louvered basement vent required human intervention to reset the louvers in a closed position if the detents were engaged.

In 1994, Schedegger and others filed a patent application for a plastic foundation vent and were issued U.S. Pat. No. 5,487,701 in 1996. The Schedegger device is similar in construction to the Wagedes device, in that it comprised independent louvers that could be held in an open position as well as a screened opening. Like Wagedes' device, Schedegger's device was limited to addressing only one type of pressure differential and required human intervention to release opened louvers.

In 1999, Montgomery filed a patent application for a device and method for relieving flooding from an enclosed space. He was issued U.S. Pat. No. 5,944,445 in 1999. The Montgomery device includes a swinging door capable of swinging both in and out of the structure to permit tidal water flow in and out of the structure. The swinging door has a spring loaded hinge and is held in a closed position by a catch assembly. The catch assembly includes an adjustable screw, a catch spring, a ball bearing and threaded sleeve. The automatic opening of the device in response to floodwaters pressing against the door is a function of adjusting the catch assembly. Improper adjustment of the catch assembly could range from a premature door opening (by animals) to failure of the door to open. Furthermore the manufacturing and assembly of such a device require skilled labor. In the same year, Montgomery and other filed a patent application for a foundation flood gate with ventilation. U.S. Pat. No. 6,287,050 was issued in 2001 for the device. Like his previous device, the foundation flood gate with ventilation included a swinging door capable of swinging in both directions to allow water to flow in or out of the structure. Automatic activation of the door is performed by a catching assembly. The catching assembly included a float for sensing the level of the water and releasing the door when the level exceeds a preset height. Automatic opening of the door requires an intact and freely movable float within the device. While requiring fewer parts than his previous device, the catching assembly still requires skilled labor to manufacture and assemble. In 2001, Montgomery and others filed a similar application for a foundation flood gate with ventilation but the latch assembly senses fluid force acting upon the door rather than relying upon a float to sense water level. In 2002, the United States Patent and Trademark Office issued U.S. Pat. No. 6,485,231 for the device. The device included a latching assembly which requires skilled labor to manufacture and assemble for proper operation.

Sprengle and other filed an application in 2002 for a flood gate for a door. In 2004, U.S. Pat. No. 6,692,187 was issued for the device. The Sprengle device incorporated both the pressure and float sensing features of Montgomery's devices and further allowed for the gate to be used in an overhead door application without the door automatically swinging open when the overhead door is opened. Like the Montgomery devices, the Sprengle device requires skilled labor to manufacture and assemble for proper operation.

Finally, in 2007 Albanese was issued U.S. Pat. No. 7,270,498 for a flood vent which relies upon a door with floatation slideably mounted to a frame which automatically opens (or closes) based upon the level of the floodwaters. While Albanese reduces the number of moving parts and thereby reduces the need for skilled labor, the device still requires proper manufacturing tolerances and assembly to ensure free sliding movement of the door within its tracks. Furthermore the Albanese device has no means to automatically open in response to force upon the door.

As can be seen above the need for a flood vent that can open automatically, provide ventilation, yet have a minimal number of moving parts is desirable.

SUMMARY OF THE INVENTION

The present invention is directed to a flood vent 10 comprising a shuttered duct 15, with an upper and lower region, formed in a housing 20 fixed in a structure, such as a house, building, wall, door or overhead door at an elevation above ground level. See FIGS. 1, 4, and 6. A lower region of duct 15 is angled down between two degrees)(2°) and eight degrees (8°) from a horizontal plane to form a sill 28 that sheds water to an exterior of the structure. See FIGS. 1, 4, and 6. The present flood vent 10 includes a shutter 30 which is pivotally fixed in duct 15. Duct 15, sill 28 and shutter 30 are configured to allow the unimpeded movement of floodwaters in and out of the structure, when present; and further deter animals from using the flood vent 10 as a passageway in and out of the structure. Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

BRIEF DESCRIPTION OF DRAWINGS

The present invention is further described in connection with the accompanying drawings, in which.

DETAILED DESCRIPTION OF THE INVENTION

Figure 1:
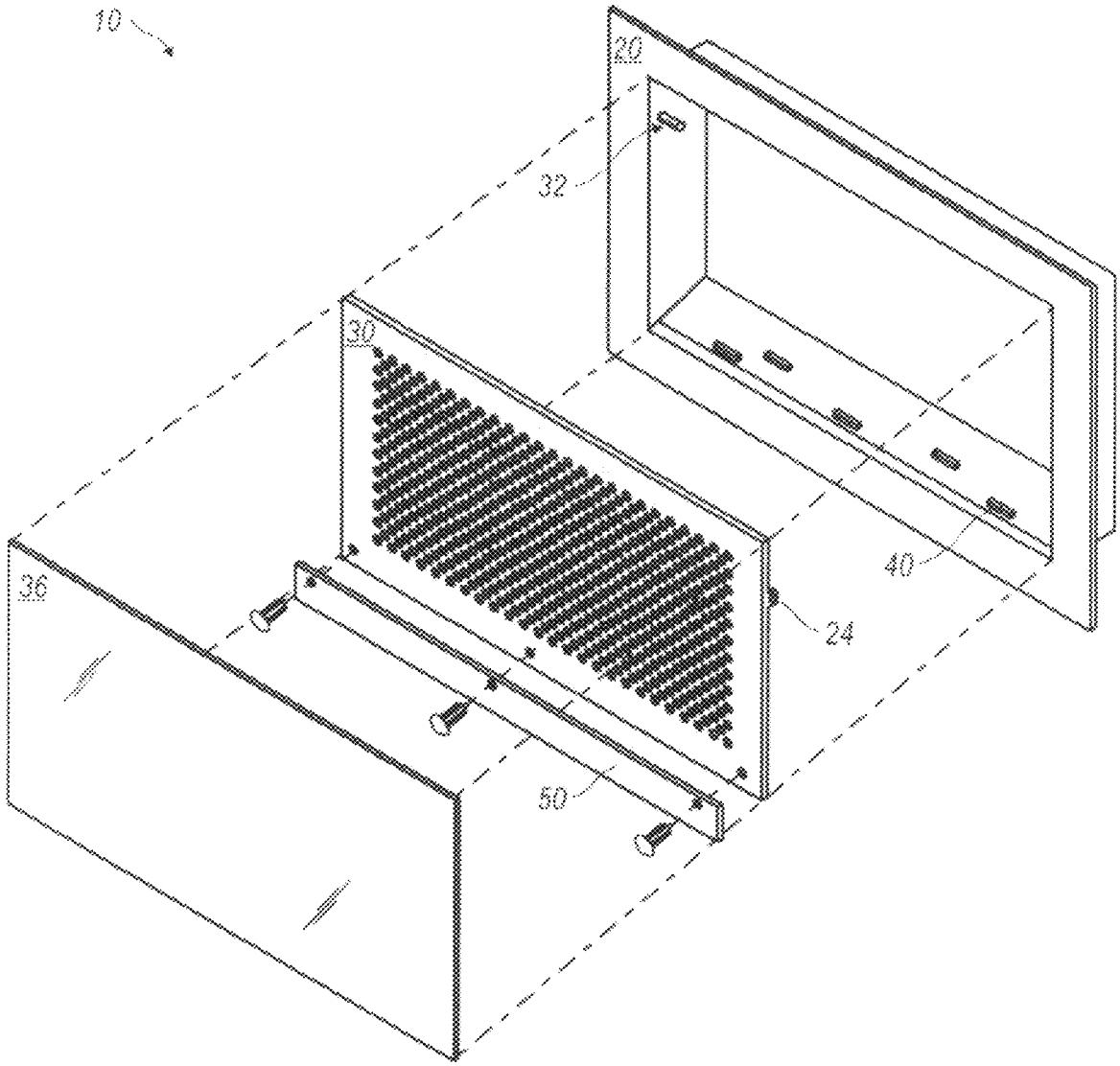
FIG. 1 is an exploded isometric view of an embodiment of the flood vent.
Figure 2:
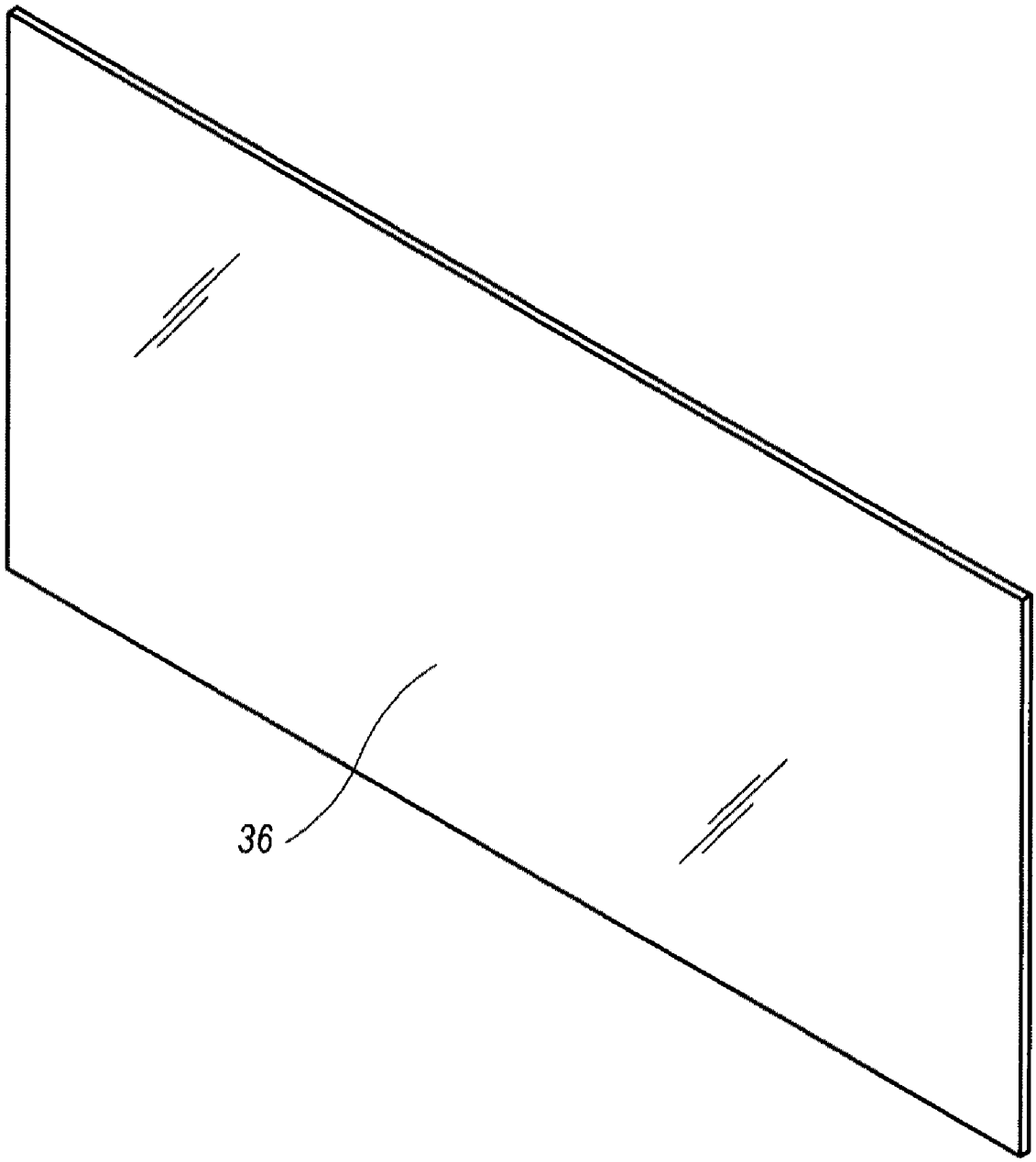
FIG. 2 is an isometric view of a hood for said flood vent.
Figure 3:
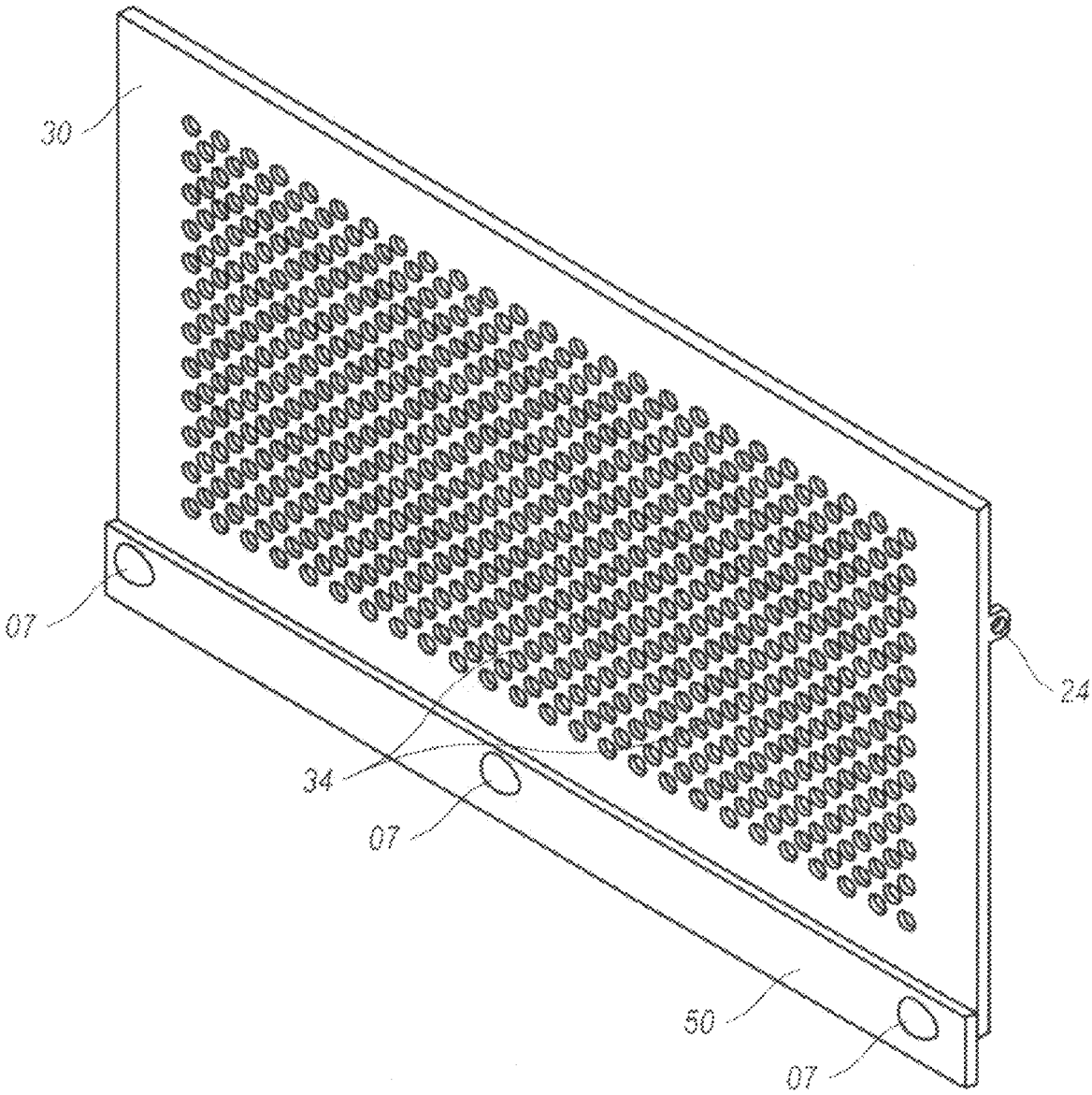
FIG. 3 is an isometric view of an embodiment of a flood vent shutter.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Certain terminology will be used in the following description for convenience and reference only and not for purposes of limitation. For example, the words "rightwardly", "leftwardly", "upwardly" and "downwardly" will refer to directions in the drawings to which reference is made. The words "inwardly" and "outwardly" refer to directions toward and away from, respectively, the geometric center of the structure being referred to. This terminology includes these words, specifically mentioned derivatives thereof, and words of similar import. Furthermore, elements may be recited as being "coupled"; this terminology's use anticipates elements being connected together in such a way that there may be other components interstitially located between the specified elements, and that the elements may be connected in fixed or movable relation one to the other. Certain components may be described as being adjacent to one another. In these instances, it is expected that such a relationship so described shall be interpreted to mean that the components are located proximate to one another, by not necessarily in contact with each other. Normally there will be an absence of other components positioned there between, but this is not a requirement. Still further, some structural relationships or orientations may be designated with the word "substantially". In those cases, it is meant that the relationship or orientation is as described, with allowances for variations that do not effect the cooperation of the so described component or components.

Figure 4:
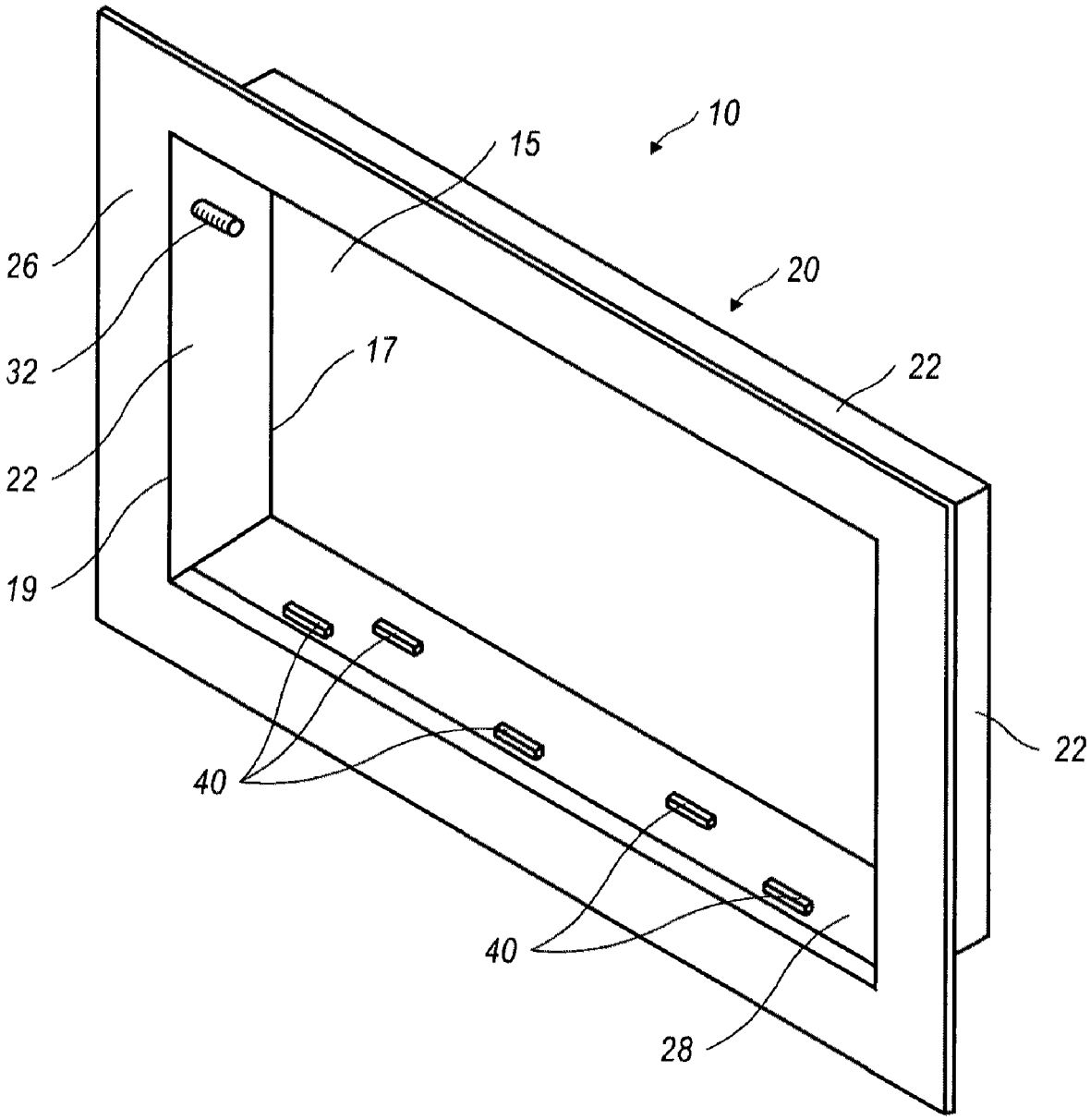
FIG. 4 is an isometric view of an embodiment of a flood vent housing.
Figure 5:
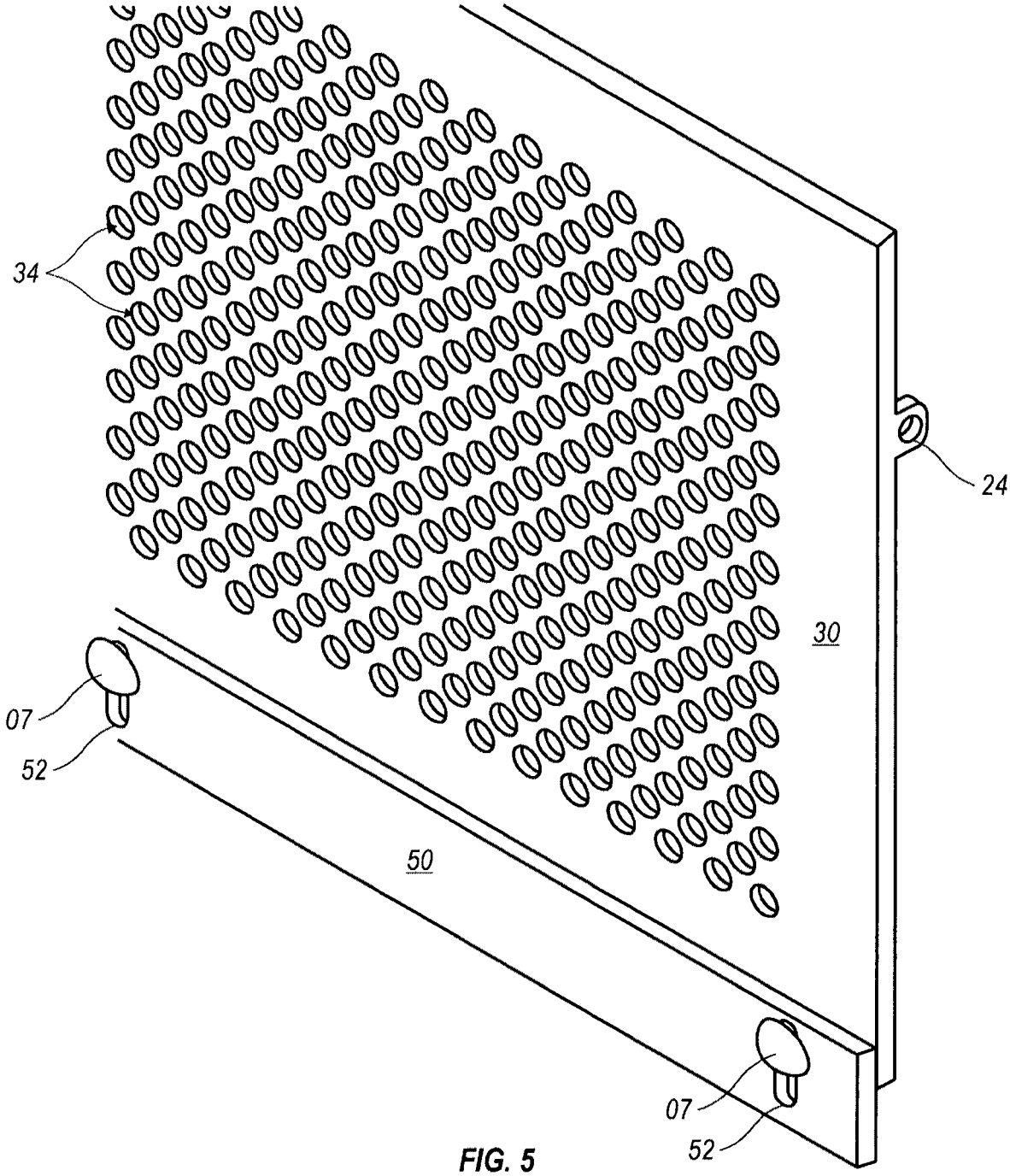
FIG. 5 is an isometric detail view of another embodiment of a flood vent shutter.
Figure 6:
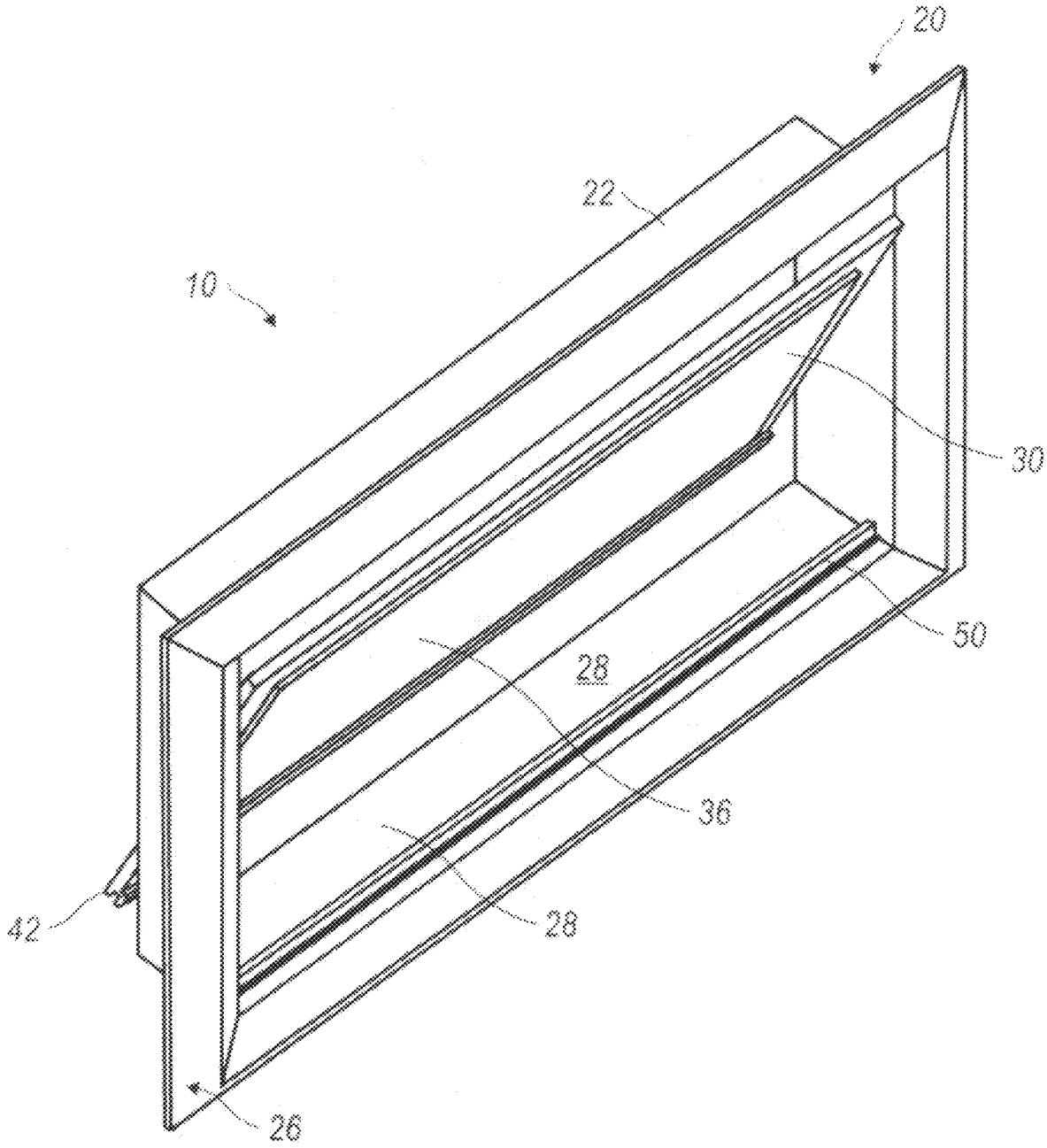
FIG. 6 is an isometric view of an embodiment of a flood vent.
Figure 7:
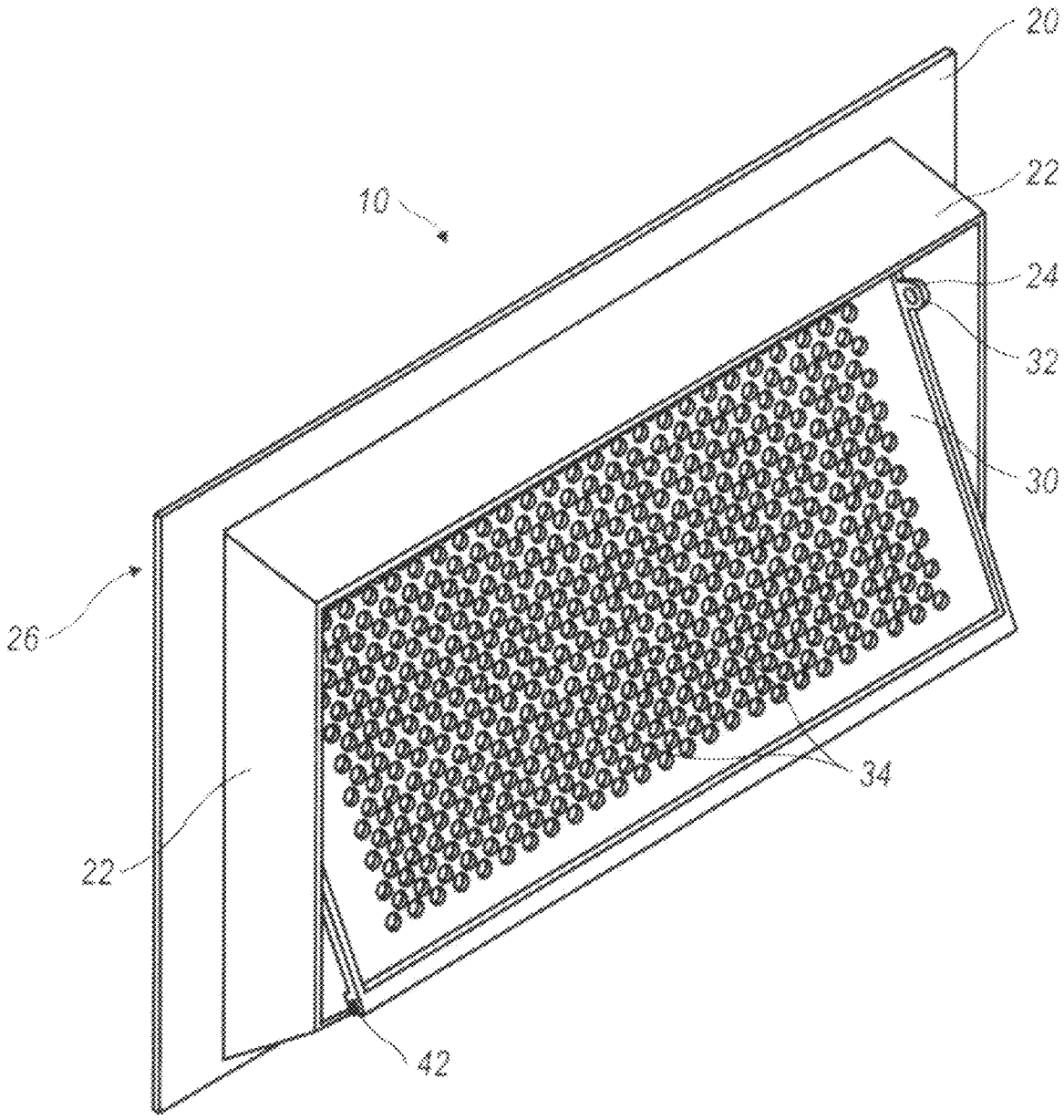
FIG. 7 is an isometric view of an embodiment of a flood vent.

The present flood vent 10 comprises a bezel 26 connected to two opposing walls 22, an upper wall 22 and a sill 28 to form a duct 15 within a housing 20. See FIGS. 1, 4 and 6. The flood vent 10 has an interior duct opening 17 on the inside of the structure and an exterior duct opening 19 on the outside of the structure. See FIG. 4. Duct 15 allows fluid communication between the interior and exterior of the structure when floodwaters rise above sill 28.

Bezel 26 surrounds a periphery of an exterior duct opening 19 and serves to attach housing 20 to structure by fasteners or adhesive. Housing 20 can have outer dimensions that correspond with the nominal dimensions of concrete masonry units (CMU). In a preferred embodiment, housing 20 has outer nominal dimensions that correspond to a CMU-8, namely eight inches (8") high, sixteen inches (16") long and eight (8") wide (all nominal dimensions). Housing 20, walls 22, bezel 26, and sill 28 can be constructed of materials such as metal, plastic, concrete, cement, composites or a combination thereof.

A shutter 30 is pivotally fixed to an upper region of duct 15 so that shutter 30 is capable of swinging in two directions, namely in and out of the structure. It is contemplated that shutter 30 can move about a swing arc that can be approximately one hundred and sixty degrees)(160°) to approximately two hundred and twenty five degrees (225°).

A lower region of shutter 30 is releasably coupled to a portion of sill 28 by a fin 50. A coupling region is that portion of shutter 30 swing arc where fin 50 is in contact with a portion of sill 28, at least one tab 40 fixed to and projecting away from sill 28, or a combination of both. Movement of shutter 30 to, from or through a coupling region is hampered by the releasable coupling of shutter 30 to sill 28 by fin 50. The presence of at least one tab 40 fixed to and projecting away from sill 28 hampers movement of shutter 30 to, from, or through a coupling region. The size of a coupling region varies with the width of fin 50, angle of sill 28 and the presence of at least one tab 28. It is contemplated in one embodiment, that when fin 50 is within a coupling region, shutter 50 is in a closed position that substantially obstructs duct 15 and deters animal use of flood vent 10 as a passage through the structure. Movement of shutter 30 about a swing arc can be in response to a floodwater pressure differential in or across duct 15, movement of floodwater against shutter 30, floatation of shutter 30, or a combination thereof.

Shutter 30 can be pivotally fixed to an upper region of duct 15 by a variety of pivoting mechanism known to those skilled in the art of flood vents. In a preferred embodiment, a pair of opposing pin holes 24 is formed in an upper region of shutter 30 to receive a corresponding pin 32 fixed and projecting away from an upper region of duct 15. See FIGS. 1, 3, 4, 5, and 7. This arrangement allows a shutter 30 to rotate freely about a substantially horizontal axis above sill 28.

Fin 50 can be fixed to shutter 30, sill 28 or neither as set forth in the following descriptions. In a first embodiment, fasteners 07 fix fin 50 to a lower region of shutter 30 so that it projects away from a lower region of shutter 30. See FIGS. 1 and 3. In such an embodiment, fin 50 can be fixed to a lower region of shutter 30 by fasteners 07 or slidably fixed to a lower region of shutter 30 by fasteners 07 passing through corresponding slots 52 formed in fin 50. See FIGS. 3 and 5. As the reader can appreciate, a slideably fixation of fin 50 to a lower region of shutter 30 alters the coupling region without altering the width of fin 50. In a preferred embodiment, at least one tab 40 is fixed to and projects away from sill 28 to releasably couple with fin 50 to hamper movement of shutter 30 to, from or through a closed position or a coupling region. See FIGS. 1 and 4. In a second embodiment, fin 50 is fixed to and extends away from sill 28 to releasably couple with a receiver 42 formed in a lower region of shutter 30. See FIGS. 6 and 7. In such an embodiment, the size of a coupling region is a function of the cross sections of fin 50 and receiver 42 as well as the angle of sill 28. In a third embodiment, fin 50 is releasably coupled to both shutter 30 and sill 28 by a first receiver 42 formed in a lower region of shutter 30 and a second receiver 42 formed in sill 28. It is contemplated that such an embodiment would require a user to couple or re-couple shutter 30 with sill 28 after movement of shutter 30 beyond a coupling region.

It is contemplated that duct 15 and shutter 30 can be circular, arcuate, polygonal or a combination thereof in shape when viewed from a duct opening 17 or 19.

In another embodiment, a plurality of holes 34 is formed in shutter 30 to allow movement of fluid through shutter 30. Such holes 34 allow ventilation between the interior and exterior of the structure when shutter 30 is in a closed position. It is further contemplated that a hood 36 can be removably fixed to shutter 30 to impede the movement of fluid through shutter 30.

It is contemplated that shutter 30 and hood 36 can be constructed from metal, plastic, composites or a combination thereof. Furthermore, shutter 30 can be constructed with material(s) with a low density such that at least a portion of shutter 30 is buoyant in floodwater of a sufficient depth within said duct 15.

In any of the embodiments described above, the presence of a substantial amount of floodwater within at least a portion of duct 15 causes shutter 30 to move about its swing arc and allows the flow of floodwater between an interior and exterior of the structure. In the absence of a substantial amount of floodwater within duct 15, shutter 30 is in a closed position or within a coupling region to substantially obstruct duct 15 and deter animal use of flood vent 10 as a passage through the structure. Finally, the number of parts used in the different embodiments of the present flood vent 10 is greatly reduced over existing devices which in turn reduces the cost of manufacturing and assembly. Likewise, the reduction in parts eliminates or reduces the likelihood of failure.

A flood vent 10 and its components have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

The invention claimed is:

1. A flood vent for a structure comprising:

a shuttered duct with an upper and lower region formed in a housing fixed in the structure to allow the unimpeded movement of floodwaters through the structure, wherein said lower region of said duct is angled down between two and eight degrees from a horizontal plane to form a sill that sheds water to an exterior of the structure;

said upper region of said duct is pivotally fixed to a shutter positioned within said duct, wherein said shutter swings between a closed position and an open position in response to a floodwater pressure differential in said duct; and a lower region of said shutter releasably coupled to a portion of said sill by a fin, wherein width of said fin and angle of said sill defines a coupling region along said sill wherein said shutter substantially obstructs said duct to prevent animal passage along said duct and wherein said fin is slideably fixed to said lower region of said shutter to alter said coupling region between said shutter and said sill.

2. A flood vent for a structure comprising:

a shuttered duct with an upper and lower region formed in a housing fixed in the structure to allow the unimpeded movement of floodwaters through the structure, wherein said lower region of said duct is angled down between two and eight degrees from a horizontal plane to form a sill that sheds water to an exterior of the structure;

said upper region of said duct is pivotally fixed to a shutter positioned within said duct, wherein said shutter swings between a closed position and an open position in response to a floodwater pressure differential in said duct; and a lower region of said shutter releasably coupled to a portion of said sill by a fin, wherein width of said fin and angle of said sill defines a coupling region along said sill wherein said shutter substantially obstructs said duct to prevent animal passage along said duct and wherein an upper region of said fin is releasably coupled with a first receiver formed in said lower region of said shutter and a lower region of said fin is releasably coupled with a second receiver formed in said sill.

* * * * *